US006029595A

United States Patent [19]

Bachmann

[11] Patent Number: 6,029,595

[45] Date of Patent: Feb. 29, 2000

[54] EXTERNAL WATER BALLAST CONTAINER FOR SAILBOATS

[76] Inventor: Helmuth G. Bachmann, 339 GreenLake Dr., Sunnyvale, Calif. 94089

[21] Appl. No.: 09/209,853

[22] Filed: Dec. 11, 1998

[51] Int. Cl.[7] ..... B63B 39/03

[52] U.S. Cl. ..... 114/125; 114/364

[58] Field of Search ..... 114/39.17, 61.11, 114/121, 122, 123, 125, 364

[56] References Cited

U.S. PATENT DOCUMENTS

| | | | |
|---|---|---|---|
| D. 400,492 | 11/1998 | Bachmann . | |
| 4,217,845 | 8/1980 | Hood | 114/125 |
| 4,441,445 | 4/1984 | De Weck | 114/61.11 |
| 4,516,516 | 5/1985 | Methven | 114/61.11 |
| 4,759,307 | 7/1988 | Scott | 114/121 |
| 4,972,788 | 11/1990 | Berger | 114/61.15 |
| 5,060,591 | 10/1991 | Ciavarra | 114/123 |
| 5,215,025 | 6/1993 | Talmor | 114/56 |
| 5,622,130 | 4/1997 | Calderon | 114/39.1 |
| 5,636,585 | 6/1997 | Schutz | 114/123 |

FOREIGN PATENT DOCUMENTS

| | | | |
|---|---|---|---|
| 553677 | 6/1932 | Germany | 114/125 |

OTHER PUBLICATIONS

Michael Carr, Gray Wolf: A Well Disguised Race Horse, Cruising World Magazine, Jun. 1997, pp. 90–92, The New York Times Company Magazine Group, Inc, USA.

Steve Dashew, Precision Passage, Cruising World Magazine, Aug. 1998, pp. 34–39 The New York Times Company Magazine Group, Inc, USA.

*Primary Examiner*—Jesus D. Sotelo

[57] ABSTRACT

A ballast container attached to the outside of a sailboat for holding controlled quantity of water as ballast to provide a controllable stabilizing force thereon. The container includes a method of attachment to the windward rail of the sailboat and a means of filling and draining controlled quantities of water. The container is formed of foldable water tight material that fills to shape when receiving and holding water and collapses for stowage on and off the beam rail when not in use.

29 Claims, 10 Drawing Sheets

EXTERNAL WATER BALLAST CONTAINER FOR SAILBOATS

BACKGROUND OF THE INVENTION

This invention relates to the use of water ballast as a stabilizing force on a sailboat. Many new high performance racing and cruising sailboats are being manufactured with built-in rigid internal water ballast tanks to improve their upwind performance, without sacrificing downwind performance. This is accomplished by filling the windward ballast tank with water while going upwind to stabilize the sailboat, and emptying the ballast when going downwind for less weight. Examples of internal water ballast being used in new high performance cruising sailboats can be found in CRUISING WORLD magazine articles in June 1997, on page 91, and in August 1998, on page 36.

Water ballast simply works by reducing the angle of heel on a sailboat. It makes the keel, rudder and sails increase their lift in the horizontal direction, which generates greater driving and tracking forces that make the sailboat go faster. Although there is additional drag from the hull with the added ballast weight, it is minimal when compared to the gain. Most modern sailboats are light and have flatter under bodies which are capable of going beyond their normal hull speed while planing. Speeds beyond hull speed are generally achieved going down wind in brisk conditions having good driving force, when the sailboat's bottom sections are kept flat on the water for planing. The driving forces on a reach or upwind are not as direct, which makes the sailboat heel and the flat bottom sections are not longer being presented. Adding water ballast on the windward beam while on a reach reduces the heeling angle, which again presents a flatter bottom for planing and increases the driving forces which makes the sailboat go faster.

Light modern cruising sailboats also tend to have a harsh motion in heavy seas. This can make it uncomfortable and difficult to perform normal tasks on ocean passages, with excessive heeling only aggravating the situation. By adding additional water ballast weight on the windward beam, rolling and tossing are dampened and more velocity is sustained through oncoming waves. With slower and less internal movement, as well as angle of heel, one has a more comfortable and safer sea kindly ride in heavy seas, with less time spent at sea with the added speed. Also, water ballast can be placed on both sides of the sailboat to reduce rolling at anchorage.

Unfortunately, any attempt to add internal water ballast to sailboats without preexisting ballast tanks would require major reconstruction and would not be practical or cost effective, and the internal tanks would take up valuable space.

BRIEF SUMMARY OF THE INVENTION AND OBJECTS

It is the general object of the present invention to provide a ballast container to carry water ballast as a stabilizing force on any existing sailboat without alterations to the sailboat itself, providing the advantages of built-in internal water ballast and overcoming the above disadvantages and limitations.

It is a further object to the present invention to provide a ballast container with a greater stabilizing force or moment for the same amount of water as with internal water ballast. This achieved by holding the ballast water external to the sailboat's hull, out from the beams end, which also does not use up valuable internal space.

It is a further object to the present invention to provide a ballast container that can be transferred from one side of the sailboat to the other, and from one sailboat to another sailboat. This is achieved with rotatable attachment hooks that can attach to either side of the sailboat on most sailboat's beam rail and a self contained means of filling and draining the container on any sailboat.

It is a further object to the present invention to provide a ballast container that is easily filled and drained with ballast water on the windward side of the sailboat while under sail, and doesn't require active pumping for the emergency release of water.

It is a further object to the present invention to provide a ballast container that is filled and drained automatically of ballast water to stabilize the sailboat from heeling. This achieved with a controlling device which senses the angle of heel of the sailboat and controls the filling and draining pumps and valves to stabilize the sailboat.

It is a further object to the present invention to provide a ballast container that can be stowed compactly when not in use on the beam rail of a sailboat hull, well above the water on the leeward side while under sail.

It is a further object to the present invention to provide a ballast container that can be stowed compactly off the beam rail, with the container being folded into several sections for compact stowage and can be easily shipped to a cruising or racing destination.

These and other features and objects of the invention will become apparent from the following detailed description when taken with the accompanying drawings and claims, of which:

BRIEF DESCRIPTION OF THE DRAWINGS

Corresponding reference numerals designate corresponding parts throughout the several views of the drawings.

DETAILED DESCRIPTION OF THE INVENTION

Figure 17:
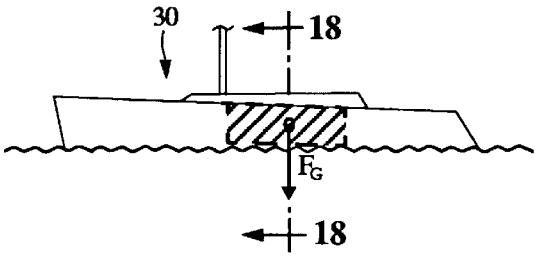
FIG. 17 is a side model view of a sailboat with internal water ballast.
Figure 19:
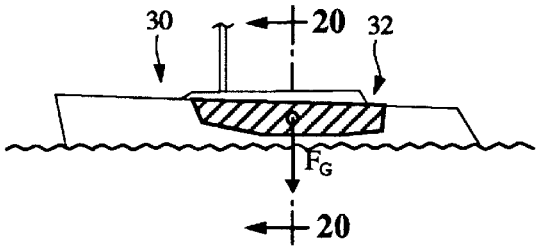
FIG. 19 is a side model view of a sailboat with external water ballast.
Figure 18:
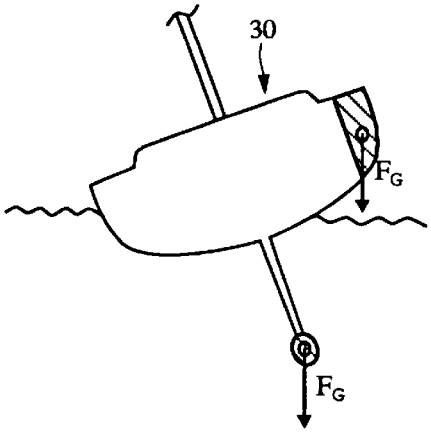
FIG. 18 is a sectional model view taken along line 18—18 in FIG. 17 of the sailboat hull with internal water ballast.
Figure 20:
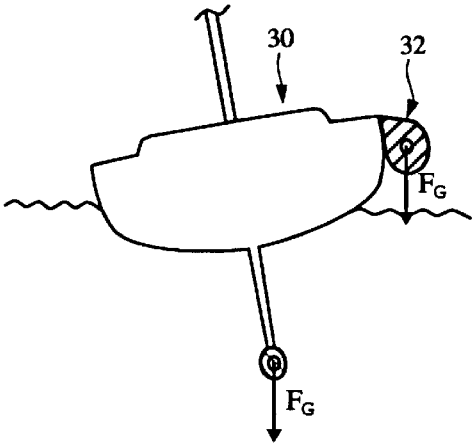
FIG. 20 is a sectional model view taken along line 20—20 in FIG. 19 of the sailboat hull with external water ballast.
Figure 21:
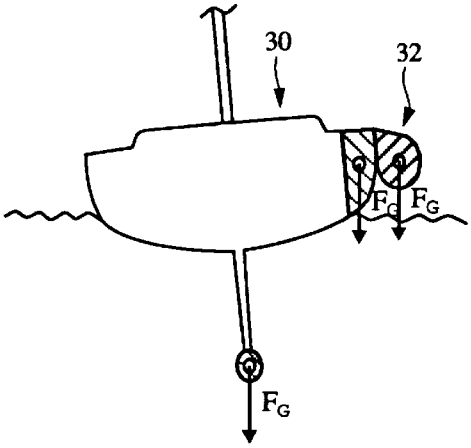
FIG. 21 is a sectional model view of a sailboat hull with internal and external water ballast.

Referring now to the drawings, and more particularly to FIGS. 1 through 4, a maritime external water ballast container of the present invention is provided for sailboats having a beam rail 31. A container 32 with elements for attachment 40 holds a controlled quantity of water as ballast to stabilize the sailboat hull 30 while under sail. A component for filling 64 or 65 (FIGS. 9 and 10) is deployed into the water for filling the container 32 with water, a flap valve assembly 106 is used to release the water, and a main draw line 126 is used to collapse the container 32 when not in use. The external water ballast container 32 and water is held outside the hull as shown in FIGS. 19 and 20, as opposed to an existing internal water ballast tank as shown in FIGS. 17 and 18. For equivalent quantities of water with the same forces of gravity FG, the stabilizing force or moment is greater with the external ballast container 32 since the water is held further out from the sailboat hull 30 as shown in FIG. 20 and more clearly in FIG. 21, with the combined forces of gravity FG on the same sailboat hull 30. This difference in stabilizing force or moment provides an additional advantage over internal water ballast, which makes the sailboat go faster. Unlike conventional internal water ballast tanks which are integrally constructed into the sailboat hull 30, external ballast container(s). 32 can be attached to existing sailboats without modification to the sailboat hull 30. The method of attachment of this embodiment (FIG. 5) is designed to handle a variety of sailboats having different rail 31 shapes and size.

Figure 1:
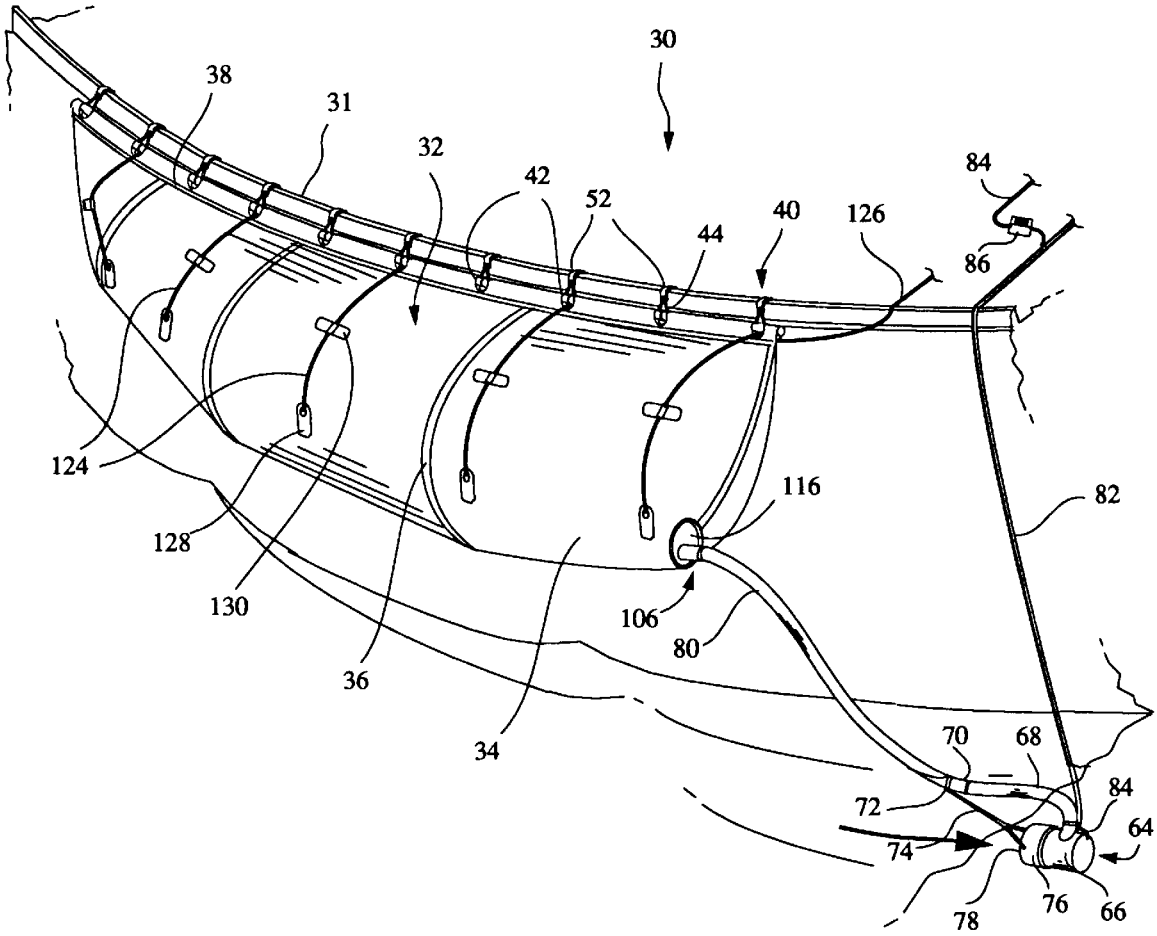
FIG. 1 is a perspective elevational view of a partial sailboat hull and rail utilizing the present invention.
Figure 2:
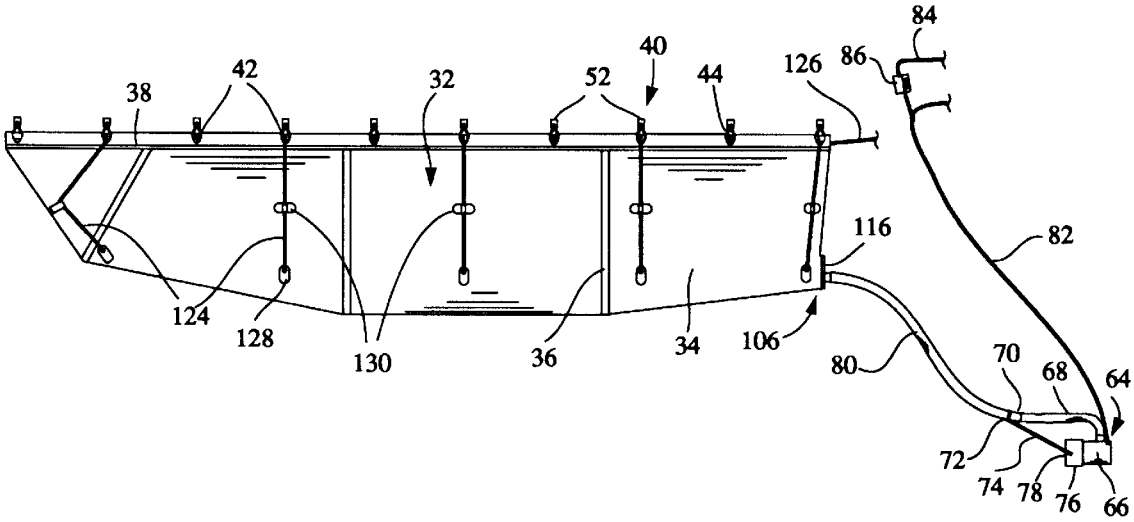
FIG. 2 is a side elevational view of the present invention.
Figure 3:
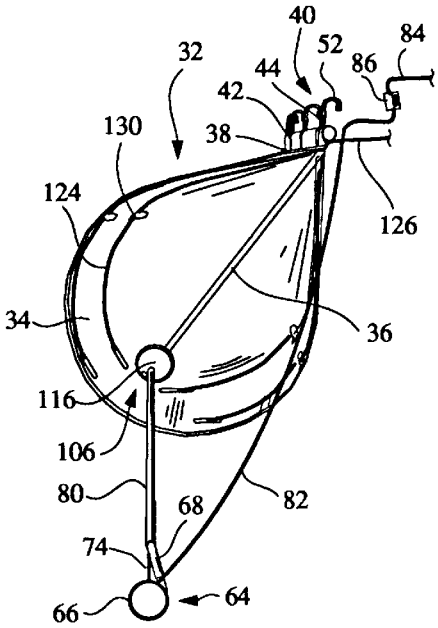
FIG. 3 is a rear elevational view thereof.
Figure 4:
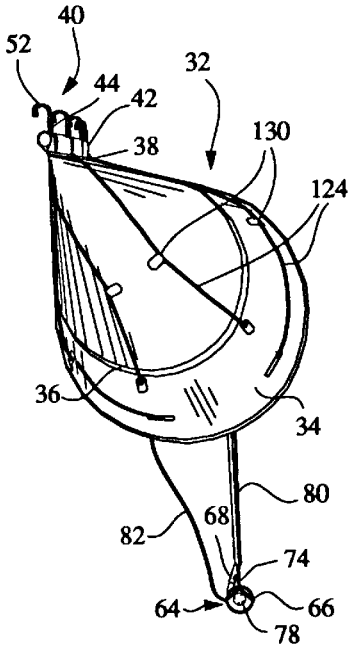
FIG. 4 is a front elevational view thereof.
Figure 5:
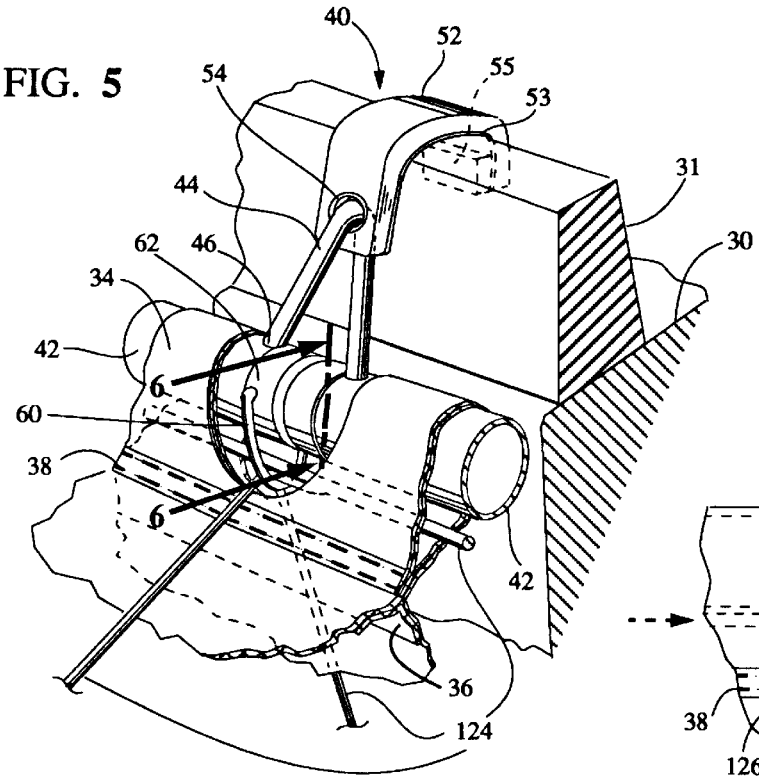
FIG. 5 is an enlarged fragmentary perspective elevational view of the attachment elements in FIG. 1 including the rail.
Figure 6:
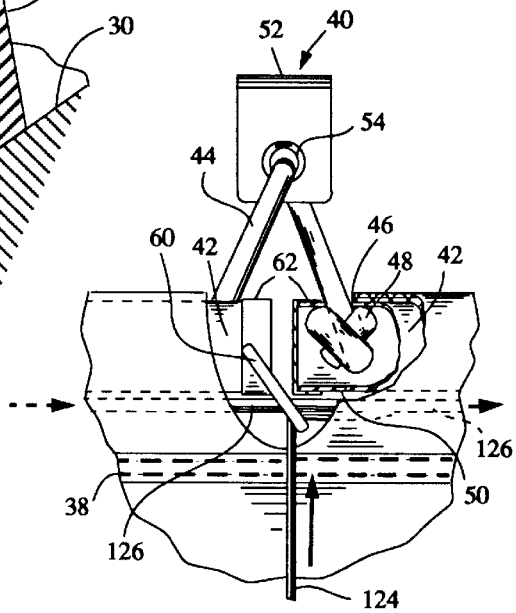
FIG. 6 is a side elevational view similar to FIG. 5 showing a sectional view taken substantially along line 6—6 in FIG. 5 of the aluminum tube to show the hook line knot.
Figure 7:
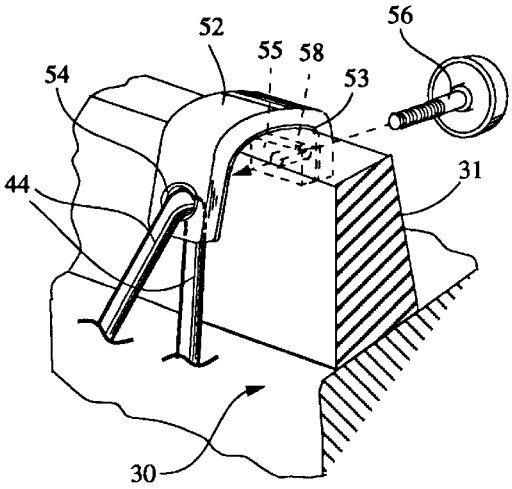
FIG. 7 is a perspective elevational view similar to FIG. 5 showing the hook and hook line.
Figure 8:
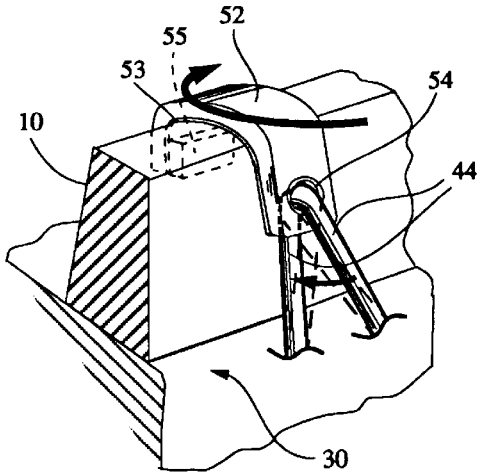
FIG. 8 is a perspective elevational view similar to FIG. 7 showing the hook and hook line rotation when attached to the rail on the opposite side of the sailboat hull.
Figure 16:
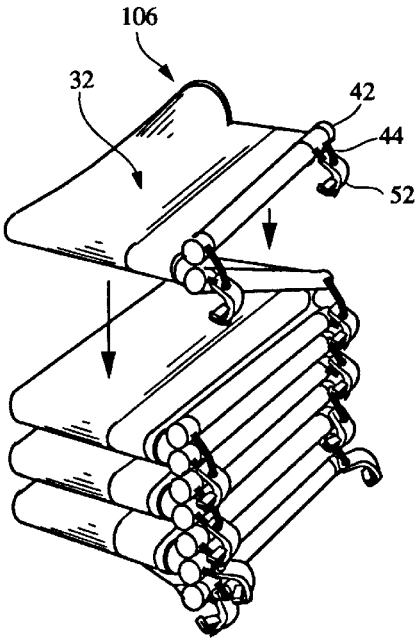
FIG. 16 is a perspective elevational view of the folded container into a compact stowage off the rail.

As illustrated in FIGS. 1 through 4, the container 32 is made of several sections of a flexible water proof material or coated fabric 34 joined by a seam 36, the top end of the fabric 34 is looped around an anodized aluminum tube 42, best illustrated in FIGS. 5 and 6, to distribute the container weight evenly across the end of the fabric 34. The end of the loop has a double stitch 38 for extra strength. Each tube 42 is aligned end to end and extend parallel to the rail 31 the length of the container 32, with each adjacent tube 42 jointed to the other by a braided polyester hook line 44 coming from the end of the tube 42. The hook line 44 is attached to the tube 42 through a line hole 46 and is held in place with a knot 48 (FIG. 6) on the other side, inside the tube 42. The tube 42 has a plastic end cap 62 on the end and a drain hole 50 to let out any water that might come in from the top line hole 46. The hook line 44 also goes through a hole 54 in the base of the rail attachment element or an anodized aluminum hook 52. The hook 52 is located along the middle of the hook line 44 between the two attachment points. The hook 52 can be used on either side of the container 32 for attachment to either side of the sailboat hull 30 as shown in FIGS. 7 and 8, since the hook line 44 rotates with the hook 52, thus the container 32 can be used on either side of the sailboat hull 30 and is symmetrical in all other respects. On the end tubes 42 the end hook line 44 runs in and out of the same tube 42 end. Also, the hook line 44 can move freely through the hole 54 in the hook 52 to distribute weight evenly to each tube 42. The hook line 44 also provides a loose pivotal joint to conform to the curvature of the rail 31 or when folding the container 32 into a compact stowage off the rail 31 as shown in FIG. 16. The hook 52 as illustrated in FIG. 7, is shaped to attach to the most common wood and aluminum sailboat rails, and is padded with a hard rubber pad 53 on the inside so as not to damage the rail and a softer rubber pad 55 which holds the hook 52 in place on the rail. As illustrated in FIG. 7, the last hook 54 at each end of the container 32 has an additional clamping screw 56 that screws through a threaded hole 58 and firmly holds the hook 52 on the rail 31 when the container 32 is emptied in strong winds.

Conventional alternative methods for attaching the container 32 to the rail 31 can be used on aluminum rails with holes and permanent installations on larger yachts. These methods are not shown in this embodiment.

Figure 9:
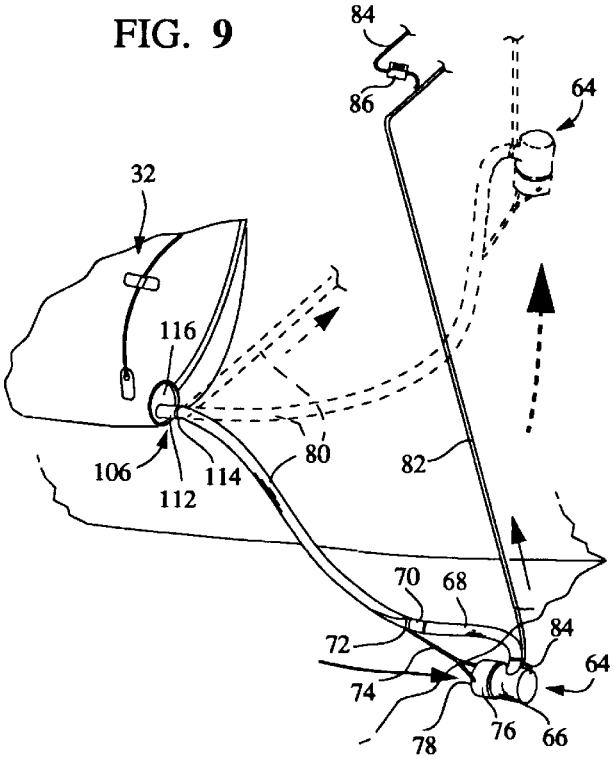
FIG. 9 is a perspective elevational view of the filling component and the draining valve of the present invention with an electrically powered pump.
Figure 10:
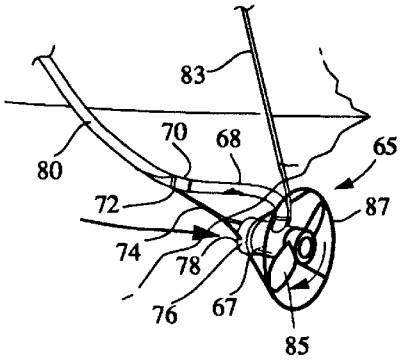
FIG. 10 is a perspective elevational view of a propeller powered pump of the present invention.
Figure 11:
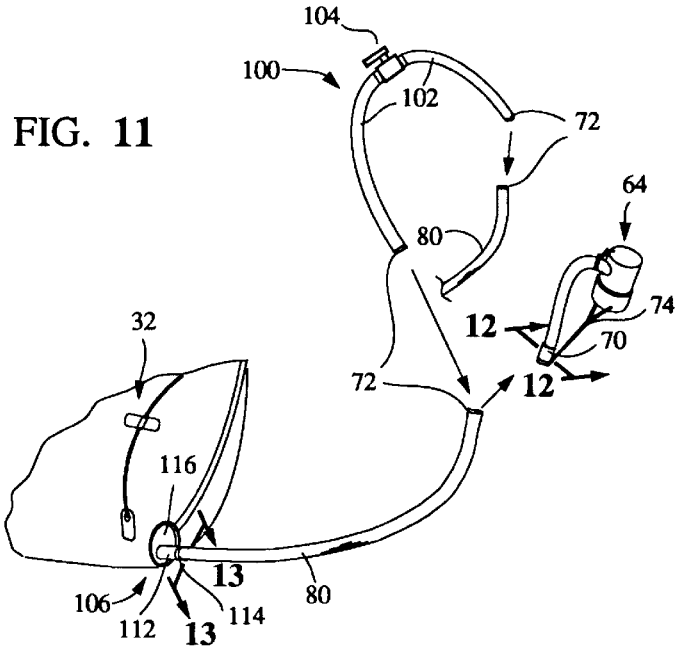
FIG. 11 is a perspective elevational view similar to FIG. 9 also showing the siphon of the present invention.
Figure 12:
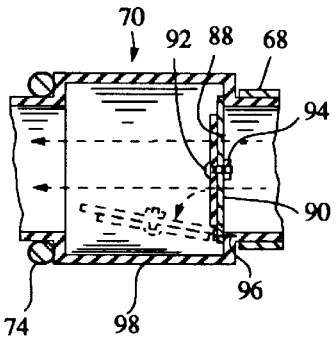
FIG. 12 is a sectional view taken substantially along line 12—12 in FIG. 11 of the one-way flapper-type vale.

Now turning to FIGS. 9 through 12, the filling component 64 or 65 of the present invention is comprised of a centrifugal water pump 66 or 67 which when deployed pumps water up into an exhaust hose 68 which has a one-way flapper-type valve assembly 70 on the end (FIGS. 11 and 12). The flapper valve 90 only lets water up into a container hose 80 and does not let it back out. This maintains water in the container 32 under pressure when the pump is not in use. The circular flapper valve 90 is made of rubber and has a hard disk 88 for backing, which will not collapse under pressure. A bridle 74 attached to the flapper valve housing 98 and intake scoop 76 keeps the intake scoop 76 facing the oncoming water while underway. The intake scoop 76 is shaped to force water into the filling component's intake 78 for added pressure and volume. The container hose 80 and flapper valve assembly 70 have conventional quick release hose connector(s) 72 which connects them together. The other end of the container hose 80 is permanently attached to the base of the container tube 112 with a stainless steel strap 114. The path of the filling water goes from the pump 66 or 67 through the exhaust hose 68, the flapper valve assembly 70, then the container hose 80 and container tube 112, and into the container 32.

When the container 32 is full, the filling component 64 or 65 is lifted or retrieved from the water using a tether line 82 or 83 respectively, as shown in FIGS. 9 and 10, and hooked onto a lifeline or secured in the cockpit (not shown).

The filling component can either be powered electrically 64 as shown in FIG. 9, or propeller powered 65 by the force of water on a propeller 85 as shown in FIG. 10. The electrically powered component is comprised of a conventional centrifugal bilge pump 66, (size varies with container size) with an attached intake scoop 78 and tether line 82 that includes the electrical power cable 84. The power cable 84 has an on and off switch 86 and is connected to the main conventional battery source of the sailboat from the cockpit. The propeller powered pump 65 works off of the moving water while underway. A propeller 85 is connected to a centrifugal pump 67 similar to the one used in the electrically powered component. A propeller guard 87 is provided to protect the sailboat hull 30 and the propeller 85 from any damage. The tether line 83 in this case does not include a power cable 84 but is handled in the same manner, except the propeller powered component 65 automatically starts pumping when submerged in the water when the sailboat is underway. Either pump takes approximately 10 minutes to completely fill an average sized container 32 and are completely interchangeable.

Figure 22:
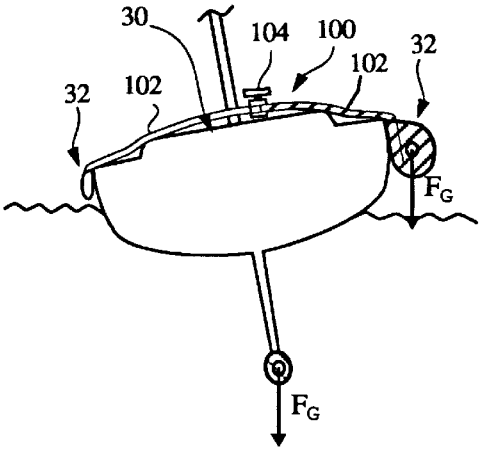
FIG. 22 is a sectional model view similar to FIG. 20 of a sailboat hull with external water ballast including a siphon hose.
Figure 23:
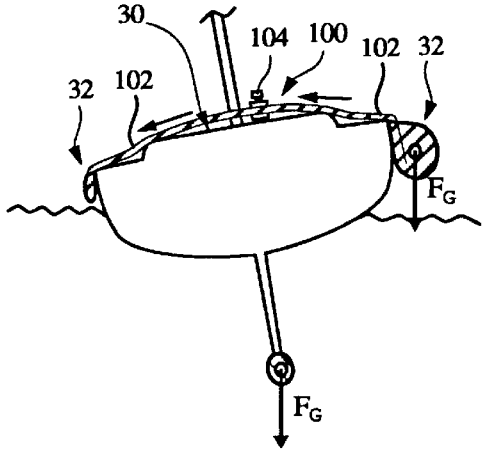
FIG. 23 is a view similar to FIG. 22 with siphon hose valve open.
Figure 24:
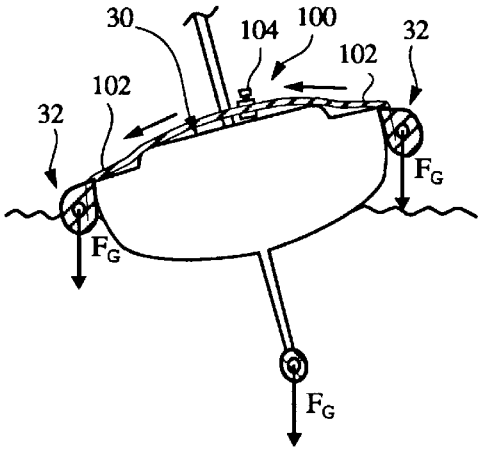
FIG. 24 is a view similar to FIG. 23 showing the transfer of ballast water.
Figure 25:
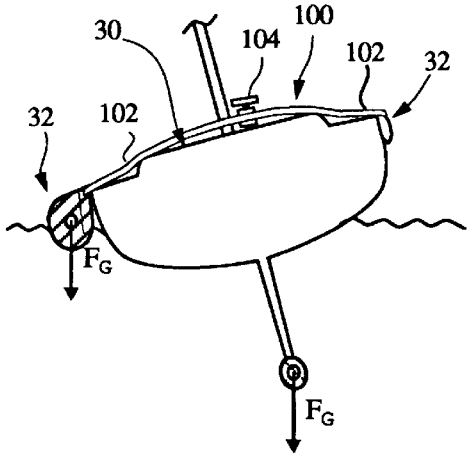
FIG. 25 is a view similar to FIG. 24 showing the complete transfer of ballast water.

The drawing models in FIGS. 22 through 25 show an alternate method of filling the container 32 without a pump, by using a siphon 100 to siphon water from one container 32 to another. To use the siphon 100 for filling the container 32, the filling component 64 or 65 is disconnected from the container hose 80 as shown in FIG. 11, then one end of the siphon hose 102 is connected to the container hose 80 and the other end to the container hose 80 with the connectors 72 to the container 32 on the opposite side of the sailboat hull 30. This will allow the water to be siphoned from one container 32 to the other when one container 32 is higher then the other as shown in FIG. 22. The siphon valve 104 is opened to start transferring water (FIGS. 23 and 24), and the siphon valve 104 is closed after the transfer of all the water is complete (FIG. 25). The sailboat can be tacked around as shown in FIG. 22, but the wind and the filled container 32 will not be on the opposite side of the sailboat hull 30.

Figure 26:
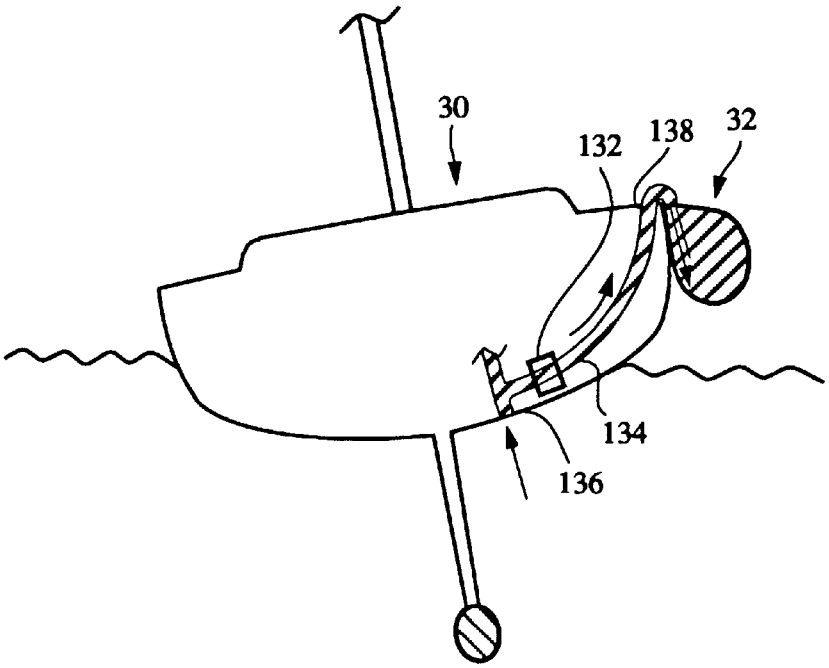
FIG. 26 is a view similar to FIG. 20 of the sailboat hull with external water ballast showing internal filling and draining elements.
Figure 27:
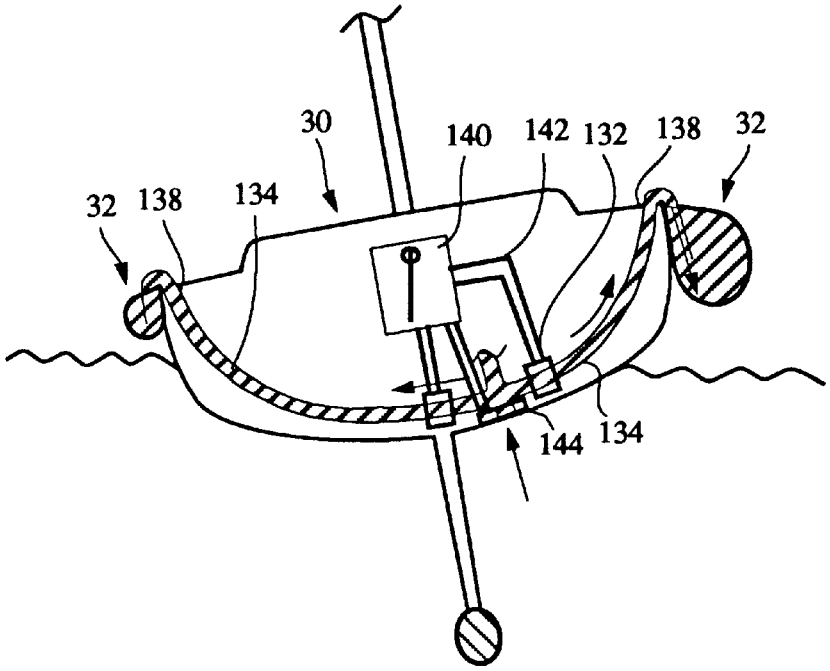
FIG. 27 is a view similar to FIG. 26 with a controlling device for the pumps and valves.

If a sailboat owner wants a more permanent filling component with less deck clutter as shown with drawing models in FIGS. 26 and 27, conventional generic pump(s) 132 with valve and hose(s) 134 connected to a sea water valve 136 are placed below deck and deck fitting(s) 138 are used to connect to the container hose 80. In this case, the container hose 80 is used to fill or drain the container(s) 32 by siphoning, or pumping water through the sea water valve 136. This allows the complete automation of filling and draining the container(s) 32 as shown in FIG. 27 with a controlling device 140 that is activated by a selected angle of heal to stabilize the sailboat. A basic controlling device 140 comprises an inclinometer that triggers the filling and draining from one container 32 to another and a pump 132 with valve, that stops when there is not more water to pump, and either container is filled. A more sophisticated controlling device 140 automatically drains the container(s) 32 after a certain period of time going downwind (not on a tack when water is only transferred), and refills the proper container 32 when heading upwind again. A sophisticated controlling device 140 for complete automatic control of the water ballast requires a dedicated micro processor or a computer with software to monitor the angle of heal, level of water in the container(s) 32, pump(s) 132, valve 144 position and wind direction (not shown in drawings), with control wiring 142 to automatically control the sea valve 144 and water pump(s) 132.

Figure 13:
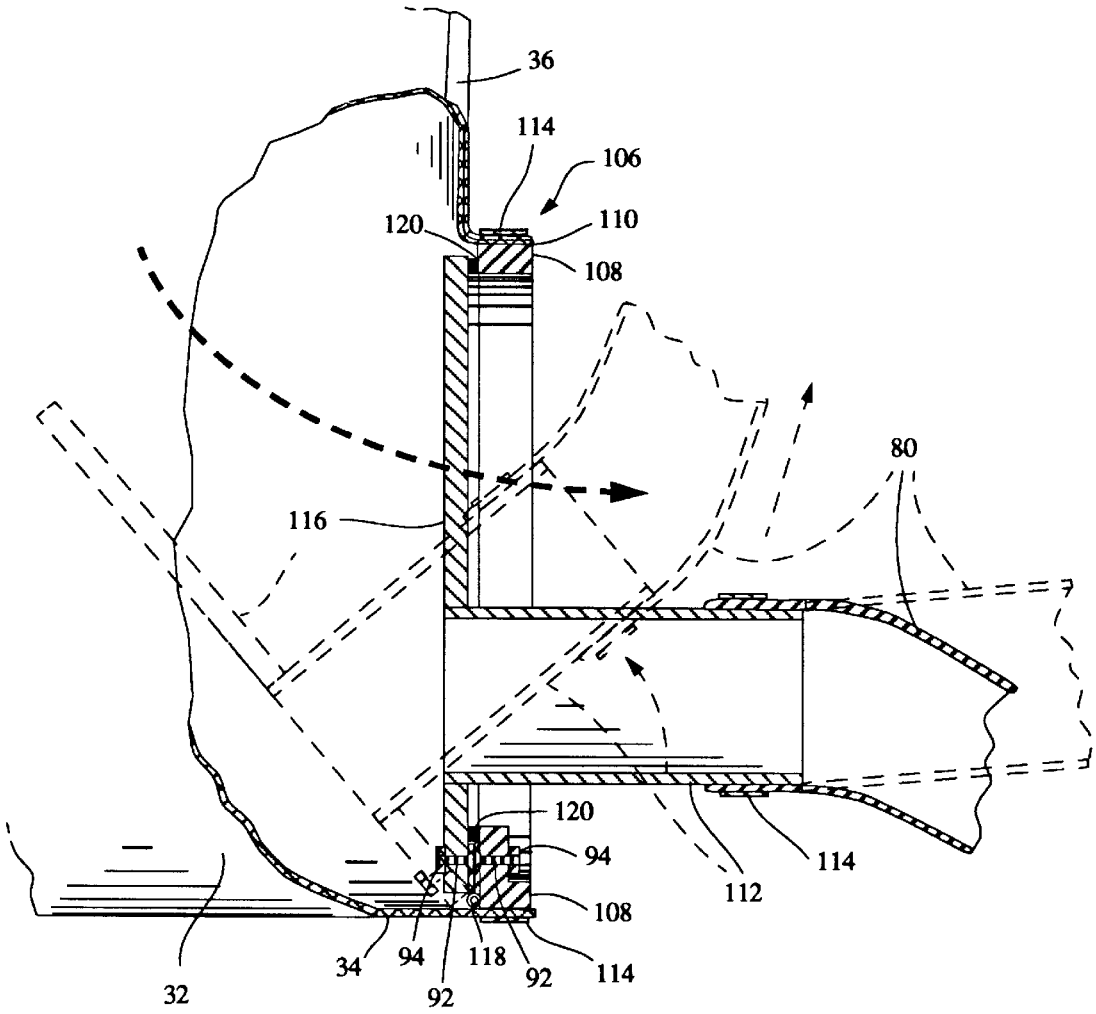
FIG. 13 is a sectional view taken substantially along line 13—13 in FIG. 11 showing the draining flap valve and flap.

As illustrated in FIGS. 11 and 13, the container draining valve 106 is comprised of a large cylindrical ring 108 glued into the base of the container 32 along the glue seam 110 and secured with a stainless steel strap 114, and a large circular rigid flap valve 116 with an integral container tube 112 which is attached to the ring 108 with a hinge 118. The container's internal water pressure holds the flap valve 116 against a circular rubber seal 120 when closed. The flap valve 116 is opened by pulling up on the container hose 80, which applies torque on the container tube 112 and flap valve 116 that is greater than the water pressure on the flap valve 116, thus rotating in on the hinge and opening the flap valve 116 as shown in FIG. 13. To close the valve 116, the container hose 80 is released and the flap valve 116 returns to the closed position. Controlled quantities of water are drained remotely with this draining valve 106. The flap valve 116 is also removable for inspecting and patching the container 32 from the inside by unscrewing the hinge attachment bolts 94 and 92.

Figure 14:
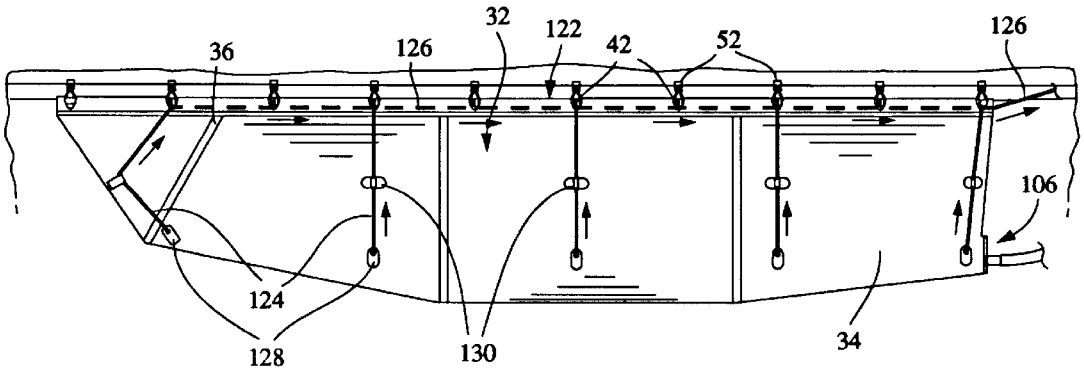
FIG. 14 is a side elevational view of the container showing the draw lines used for the stowage of the container on the sailboat rail.
Figure 15:
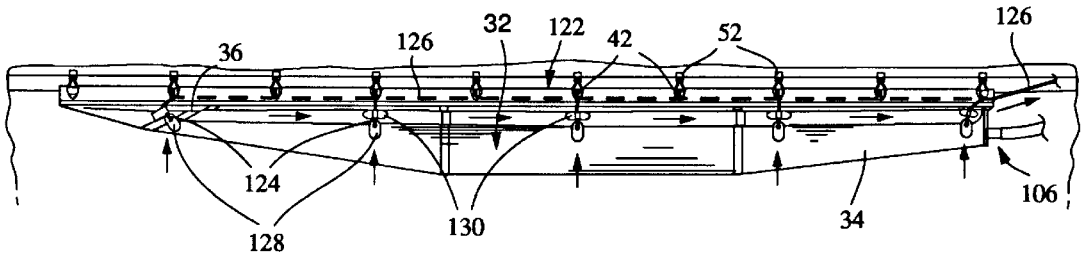
FIG. 15 is a side elevational view of the collapsed container after the draw lines are pulled for stowage on the rail.

The container 32 stowage line 122 as shown in FIGS. 14 through 16 is symmetrical on both sides of the container 32. The stowage line 122 simply comprises a set of draw lines 124 which collapse the container 32 when pulled remotely from a main draw line 126, after the container 32 has been drained (FIG. 14). The main draw line 126 runs inside the fabric loop underneath the aluminum tube 42 along most of the container 32. Each individual draw line 124 is attached at regular intervals to the main draw line 126 after running through a stainless steel loop 60 and makes a 90 degree bend (FIG. 6). The other end of each draw line 124 is attached to a draw line attachment 128 near the base of the container 32, each equidistant from the main draw line 126. When the main draw line 126 is pulled out all the way, each draw line 124 pulls the draw line attachment 128 up to the location of the main draw line 126. As show in FIG. 15, this folds the container 32 up into several sections controlled by a draw line guide 130 which the draw line 124 runs through. The sides of the container 32 are folded and held inside the base of the container 32, and the main draw line 126 is secured to a cleat on the sailboat (not shown in drawings). When the container 32 is filled the main draw line 126 is released. The main draw line 126 can optionally be attached to a long rubber band cord (not shown in drawings) which will automatically collapse the container 32 when emptied, and stretch out when filled. The collapsed container 32 can also be removed from the rail 31 and folded into a compact stowage, as shown in FIG. 16, and placed inside a carry bag (not shown in drawings).

The preferred container material 32 is made of a vinyl coated fabric 34 using heat sealed seams 36 in a similar fashion to an inflatable raft. If the container 32 is to be used to hold drinking water it will be made of a rubber coated fabric 34 without PVC in compliance with the Federal Food and Drug Administration requirements. The container 32 is built in several different sizes to accommodate a range of sailboats from 20 foot day sailers to full sized racing and cruising yachts.

Figure 28:
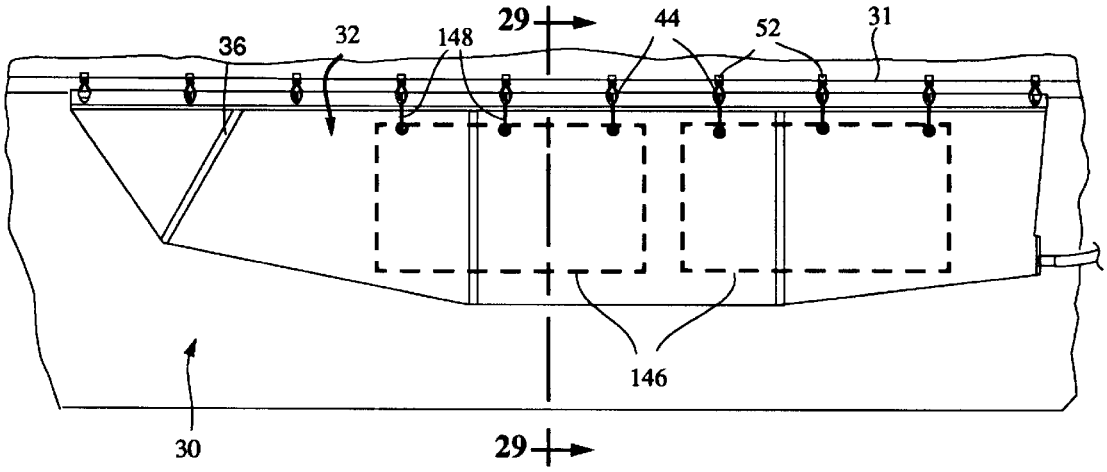
FIG. 28 is a side elevational view of the container showing the protective air cushion.
Figure 29:
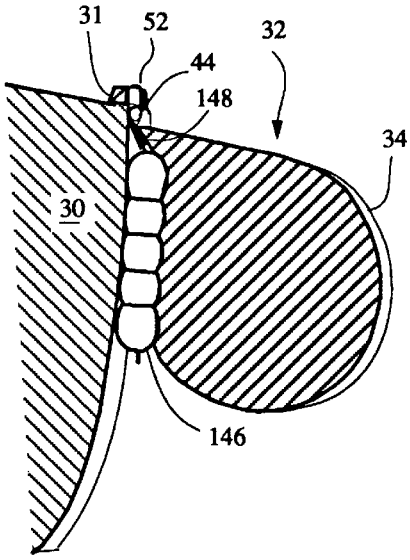
FIG. 29 is a sectional view taken substantially along line 29—29 in FIG. 28 showing the protective air cushion.

In extremely rough beam seas it may be necessary to add cushion between the container 32 and the side of the sailboat hull 30, which keeps the container 32 from banging against the sailboat hull 30. Conventional off the shelf surf mat(s) 146 as shown in FIGS. 28 and 29 are tied to hook line(s) 44 with tie(s) 148 and hung between the sailboat hull 30 and the container 32 to provide an air cushion between the sailboat hull 30 and container 32. If the demand for a permanent inflatable air cushion is warranted, it will be incorporated as part of the product.

Lastly, water ballast can also provide a method to stabilize a sailboat from rolling while at anchorage. Each container 32 is filled as it would be normally (FIG. 20) but on both sides of the sailboat hull 30 simultaneously. The ballast weight on both sides of the sailboat hull 30 dampen rolling, and if the sailboat is unevenly loaded it can be leveled by adding or subtracting water from either container 32.

What is claimed is:

1. An external water ballast container for controlling the angle of heel on a sailboat, comprising:

a container means for holding a controlled quantity of water as a stabilizing gravitational force to control heeling with said container means being formed of a foldable water tight material and interchangeable from a filled shape when receiving and holding said water to a compact collapsed shape for stowage;

an attachment means for securing said container external to a sailboat hull of said sailboat and holding the majority of said water proximal to the beamiest portion of said sailboat above the water surface and waves encountered while under sail thereof;

a means for filling and draining said container with said water; and means for stowing said container into said compact collapsed shape for stowage.

2. The external water ballast container recited in claim 1 further including a cushioning means between said container and hull of said sailboat.

3. The external water ballast container recited in claim 2 wherein said cushioning means is comprised of an inflatable air cushion between said container and said hull of said sailboat.

4. The external water ballast container recited in claim 1 wherein said foldable water tight material will not mark the hull of said sailboat.

5. The external water ballast container recited in claim 4 further in which said foldable water tight material is made of a vinyl coated fabric with seams joined by heat sealing.

6. The external water ballast container recited in claim 1 further including a means to stabilizing rolling of said sailboat at anchorage by completely filling each said container on each side of said sailboat simultaneously.

7. The external water ballast container recited in claim 1 wherein said attachment means includes a rail attachment means to attach and detach said attachment means to a beam rail of said sailboat.

8. The external water ballast container recited in claim 7 wherein said attachment means comprises a plurality of external rail attachment means connected to a plurality of stiff tubes imbedded in the upper end of said container distributing the container weight evenly over said container material, and said stiff tubes are aligned pivotally end to end extending parallel to said rail, and each said rail attachment means is attached with a flexible material to each adjacent end of each said stiff tube and the end of the last said stiff tube thereof, and each said rail attachment means attaches to said rail and said flexible material is pivotal to 180 degrees with said container material for folding along a pivotal perpendicular to the top of said container into a compact stowage means.

9. The external water ballast container recited in claim 8 in which said rail attachment means is comprised of a flat hook lined with padding to protect said rail from damage and is easily detachable from said rail.

10. The external water ballast container recited in claim 1 wherein said filling means utilizes a container hose which is connected to the bottom of said container and is used for filling the container with said water.

11. The external water ballast container recited in claim 10 in which said container hose is also used to drain said water from said container.

12. The external water ballast container recited in claim 1 wherein said container hose is used to initially fill said container with fresh potable water to be used for drinking said water.

13. The external water ballast container recited in claim 10 in which said filling means includes a water scoop to funnel moving external water to said sailboat hull while underway into the intake of said filling means and a one-way flapper-type valve to maintain water pressure in said container.

14. The external water ballast container recited in claim 13 further in which said filling means includes a water pump means.

15. The external water ballast container recited in claim 14 further in which said water pump means is a centrifugal pump.

16. The external water ballast container recited in claim 15 further including said filling means comprises said water pump which is connected to the loose end of said container hose and said water pump is deployed with a tether line into the water external to said sailboat for operation and retrieval when not in use.

17. The external water ballast container recited in claim 16 further in which said water pump means is electrically powered and includes a remotely operated on and off switch.

18. The external water ballast container recited in claim 16 further in which said pumping means is water propeller powered using the force of water external to said sailboat hull while underway.

19. The external water ballast container recited in claim 11 further in which said filling and draining means comprises a siphon hose attached to said container hose of said container on each side of said sailboat to siphon said water from one said container to another.

20. The external water ballast container recited in claim 11 further in which said filling and draining means is housed internal to said sailboat hull, and comprises a set of remotely controlled pumps and valves connected with hoses to said container hose to pump water external from said sailboat hull into and out of said container, and from said container to said container with each said container located on opposite sides of said sailboat.

21. The external water ballast container recited in claim 20 further in which said filling and draining means consists of said remotely controlled pumps and valves that are controlled by a controlling means which senses the angle of heel and controls said remotely controlled pumps and valves to stabilize said sailboat from heeling.

22. The external water ballast container recited in claim 21 further in which said controlling means includes a microprocessor with firmware.

23. The external water ballast container recited in claim 21 further in which said controlling means includes computer with software.

24. The external water ballast container recited in claim 1 wherein said draining means is located at the bottom rear end of said container.

25. The external water ballast container recited in claim 24 wherein said draining means comprises a rigid flap valve hinged on an opening in said container and is remotely openable.

26. The external water ballast container recited in claim 25 further in which said rigid flap valve hinges into said container.

27. The external water ballast container recited in claim 26 further in which said rigid flap valve is integrally attached to said container hose and remotely openable by pulling on said container hose to apply torque on said rigid flap valve.

28. The external water ballast container recited in claim 1 wherein said means for stowing said container on said rail comprises a set of draw lines attached to the bottom of said container which run up to the top of said container and collapse said container when pulled remotely from a main draw line after said container has been emptied of said water.

29. The external water ballast container recited in claim 28 further in which said means for stowing includes a compact stowage means by removing said container and said attachment means from said rail, and folding said container and said attachment means along each said pivotal 180 degrees, which folds perpendicular to the top of said container, and into said compact stowage means.

* * * * *